US005284114A

United States Patent [19]

Fukui

[11] Patent Number: 5,284,114

[45] Date of Patent: Feb. 8, 1994

[54] APPARATUS AND METHOD FOR CONTROLLING AN INTERNAL COMBUSTION ENGINE

[75] Inventor: Wataru Fukui, Himeji, Japan

[73] Assignee: Mitsubishi Denki Kabushiki Kaisha, Tokyo, Japan

[21] Appl. No.: 986,712

[22] Filed: Dec. 8, 1992

[30] Foreign Application Priority Data

Dec. 10, 1991 [JP] Japan ..... 3-326156

[51] Int. Cl.[5] ..... F02D 41/30; F02P 7/077

[52] U.S. Cl. ..... 123/414; 123/435; 123/487; 123/612

[58] Field of Search ..... 123/414, 425, 435, 476, 123/477, 487, 424, 612

[56] References Cited

U.S. PATENT DOCUMENTS 4,709,678 12/1987 Yagi et al. ..... 123/425

FOREIGN PATENT DOCUMENTS 3704839 8/1987 Fed. Rep. of Germany .
58-155278 9/1983 Japan .
62-70663 4/1987 Japan ..... 123/414
63-71548 3/1988 Japan ..... 123/435

*Primary Examiner*—Andrew M. Dolinar

*Attorney, Agent, or Firm*—Sughrue, Mion, Zinn, Macpeak & Seas

[57] ABSTRACT

An apparatus and method for controlling an internal combustion engine can perform exact timing control for ignition timing, fuel injection timing and the like in an inexpensive manner. A crank angle sensing means 20 generates a crank angle signal θ comprising a series of successive pulses in synchronization with the rotation of the engine. A cylinder pressure sensor 21 senses an internal pressure in at least one of cylinders of the engine and generates a corresponding cylinder pressure signal P. A pressure peak detecting means 42 detects a peak in the internal pressure in the at least one cylinder during an engine cranking cycle. A reference position setter 43 sets as a reference position the crank angle signal at the instant when the pressure peak in the at least one cylinder is detected. A control timing setter 44 includes a position counter for counting the number of pulses in the crank angle signal. The counter is reset in response to an occurrence to the reference position. The control timing setter is operable to set a control time Ta corresponding to a control timing for each of the cylinders on the basis of a counted value of the counter. With this arrangement, the crank angle sensing means 20 generates no reference signal and hence can be simplified.

2 Claims, 3 Drawing Sheets

APPARATUS AND METHOD FOR CONTROLLING AN INTERNAL COMBUSTION ENGINE

BACKGROUND OF THE INVENTION

This invention relates to an apparatus and method for controlling the operation of an internal combustion engine, and more particularly, it relates to such an engine control apparatus and method in which operational timing such as ignition timing of a plurality of cylinders of the engine can be controlled based on a reference position signal indicative of predetermined crankshaft angles.

In general, in an internal combustion engine having a plurality of cylinders with a crankshaft and a camshaft operatively connected therewith, a signal generator generates a reference position signal in synchronization with the rotation of the engine, based on which signal operational timing of the engine such as ignition timing, fuel injection timing and the like is determined. It is necessary that the reference position signal exactly indicate predetermined reference positions corresponding to predetermined crank angles.

FIG. 4 illustrates in block form the general arrangement of a known engine control apparatus. In this figure, the known engine control apparatus includes a signal generator 1, a sensor means 2 and a control unit 3, as will be described below in detail. The signal generator 1 generates, in synchronization with the rotation of an engine crankshaft, a crank angle signal $\theta$ comprising a series of successive pulses and indicative of the rotational position of the crankshaft as well as a reference signal T indicative of a reference position corresponding to a predetermined crank angle of each cylinder. The sensor means 2 includes a plurality of sensors such as an intake air sensor for sensing the amount or flow rate of intake air and generating a corresponding output signal representative of the engine load, a rotational speed sensor for sensing the rotational speed or the number of revolutions per minute of the engine, a temperature sensor for sensing the temperature of intake air, pressure sensors each mounted in a corresponding cylinder for sensing the internal pressure therein, and the like. The control unit 3 in the form of a microcomputer is connected to receive the output signals T, $\theta$ from the signal generator and the output signal D from the sensor means 2 and determines, based these signals, control timing such as ignition timing for each cylinder to thereby calculate a control time Ta corresponding to the thus determined ignition timing for each cylinder.

Specifically, the control unit 3 includes a reference position setting means 31 for generating a reference position signal T$\theta$ based on the reference signal T and the crank angle signal $\theta$, and an ignition timing setting means 32 for determining a control time Ta for each cylinder based on the crank angle signal $\theta$, the reference position signal T$\theta$, and the engine operating condition signal D.

The ignition timing setting means 32 includes a position counter for counting the number of pulses in the crank angle signal $\theta$ until it is reset in response to an occurrence of a reference position of each cylinder for setting a control time Ta from a predetermined reference position to an ignition timing.

FIG. 5 is a perspective view of the signal generator 1. The illustrated signal generator 1 includes a rotating disk 10 which is mounted on a camshaft 9 operatively connected with an unillustrated engine crankshaft for synchronized rotation therewith. The rotating disk 10 has a plurality of circumferentially extending slits 12 disposed at a predetermined pitch, as well as four radial slits disposed apart from each other at equal circumferential intervals. A first pair of light emitter 15 and light receiver 16 are disposed on the opposite sides of the rotating disk 10 in axially aligned relation with each other on a circle on which the circumferential slits 11 lie, in such a manner that during rotation of the disk 10, the circumferential slits 11 pass between the opposed first light emitter 15 and light receiver 16. Similarly, a second pair of light emitter 17 and light receiver 18 are disposed on the opposite sides of the rotating disk 10 in axial alignment with each other in a manner such that during rotation of the disk 10, the radial slits 12 pass between the opposed second light emitter 17 and the second light receiver 18. In the illustrated example, the number of radial slits 12 is four, which corresponds to a four-cylinder engine. When one of the slits 11 becomes aligned with the first light emitter 15 and the first light receiver 16 during rotation of the disk 10, light emitted from the first light emitter 15 passes through the now aligned slit 11 to reach the opposed second light receiver 16 which thereby generates an electric output signal in the form of a crank angle signal $\theta$. Similarly, when one of the slits 12 becomes aligned with the second light emitter 17 and the second light receiver 18 during rotation of the disk 10, light emitted from the second light emitter 17 passes through the now aligned slit 12 to reach the opposed second light receiver 18 which thereby generates an electric output signal in the form of a reference signal T.

FIG. 6 illustrates waveforms of the crank angle signal $\theta$ and the reference signal T generated by the signal generator 1. The pitch or interval between adjacent pulses in the crank angle signal $\theta$ is set, for example, to about 0.5 degrees, whereas pulses in the reference signal T are sequentially generated at reference positions of cylinders #1, #3, #4 and #2. Accordingly, the rotating disk 10 must be mounted on the camshaft 9 in a precise manner so that each of the slits 12 exactly corresponds to the reference position of a corresponding cylinder, as shown in FIG. 5.

The operation of the known engine control apparatus as described and illustrated in FIG. 4 will now be described in detail with particular reference to FIGS. 5 and 6. As shown in FIG. 6, the signal generator 1 generates, in synchronization with the rotation of the unillustrated crankshaft, a reference signal T and a crank angle signal $\theta$ which are input to the control unit 3, whereupon the reference position setting means 31 in the control unit 3 generates a reference position signal T$\theta$ with a crank angle signal $\theta$, at which the reference signal T rises, being made as a reference position.

The position counter in the ignition timing setting means 32 counts the number of pulses in the crank angle signal $\theta$ until it is reset when the reference position indicated by the reference position signal T$\theta$ occurs. The ignition timing setting means 32 determines an optimal ignition timing (i.e., a corresponding crank angle) for each cylinder based on the counted value of the position counter and the engine operating conditions D, and then calculates a control time Ta from the reference position to the thus determined ignition timing. Although at this time, the ignition timing setting means 32 normally calculates the optimal ignition timing based on a preset map which is predetermined in accordance with the engine operating conditions D, a peak position of a cylinder pressure signal contained in the engine operating condition signal D is fed back to the ignition timing setting means 32 so that it is determined, based the cylinder pressure signal, whether ignition has actually taken place at an optimal instant.

With the known engine control apparatus as described above in which the reference position signal T$\theta$ is determined on the basis of the two different kinds of pulse signals T, $\theta$ generated by the signal generator 1, two separate sensing systems corresponding, respectively, to the first and second slits 11, 12 are required, thus adding to the cost of manufacture. Moreover, in cases where the rotating disk 10 has to be mounted on the engine crankshaft, it becomes difficult to properly dispose the photocouplers 15 through 18 since a very limited space is usually available around the crankshaft in an engine room of a vehicle. Moreover, in order for the signal generator to generate the reference signal T with a high degree of preciseness, highly precise mounting of the rotating disk 10 with respect to a rotating shaft such as a camshaft, an engine crankshaft and the like is also required.

SUMMARY OF THE INVENTION

Accordingly, the present invention is intended to overcome the above-described problems encountered with the known engine control apparatus.

An object of the present invention is to provide a novel and improved apparatus and method for controlling an internal combustion engine in which a signal generator for generating a crank angle signal alone is employed, thus requiring only a single signal sensing or generating system for reduction in the manufacturing cost.

Another object of the invention is to provide a novel and improved apparatus and method for controlling an internal combustion engine in which a crank angle sensing means can be simply and easily mounted on a rotating shaft without requiring any fine adjustment while ensuring highly precise engine control.

In order to achieve the above objects, according to one aspect of the invention, there is provided an apparatus for controlling an internal combustion engine, comprising: crank angle sensing means for generating a crank angle signal comprising a series of successive pulses in synchronization with the rotation of the engine; pressure sensing means for sensing an internal pressure in at least one of cylinders of the engine and generating a corresponding cylinder pressure signal; pressure peak detecting means for detecting a peak in the internal pressure in the at least one cylinder during an engine cranking cycle; reference position setting means for setting as a reference position the crank angle signal at the instant when the pressure peak in the at least one cylinder is detected; and control timing setting means including a position counter which counts the number of pulses in the crank angle signal and which is resets in response to an occurrence to the reference position, the control timing setting means being operable to set a control time corresponding to a control timing for each of the cylinders on the basis of a counted value of the counter.

According to another aspect of the invention, there is provided a method for controlling an internal combustion engine, comprising the steps of: sensing a crank angle signal which comprises a series of successive pulses generated in synchronization with the rotation of the engine; sensing an internal pressure in at least one of cylinders of the engine; determining whether the engine is in a cranking cycle; detecting a peak in the internal pressure in the at least one cylinder during an engine cranking cycle; resetting a position counter which counts the number of pulses in the crank angle signal, when the pressure peak in the at least one cylinder is detected; and setting a control time corresponding to a control timing for each of the cylinders on the basis of a counted value of the counter.

The above and other objects, features and advantages of the present invention will be more readily apparent from the following detailed description of a preferred embodiment of the invention taken in conjunction with the accompanying drawings.

DESCRIPTION OF THE PREFERRED EMBODIMENT

A preferred embodiment of the present invention will now be described in detail while referring to the accompanying drawings.

Figure 1:
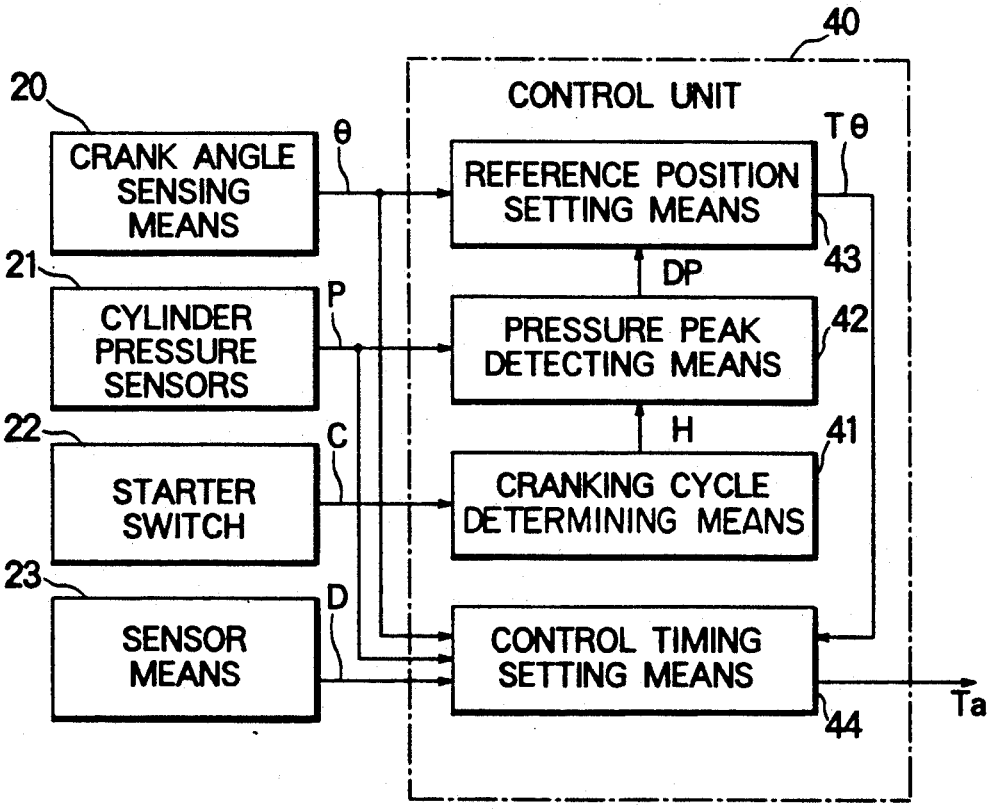
FIG. 1 is a block diagram for showing an engine control apparatus in accordance with a preferred embodiment of the present invention.
Figure 5:
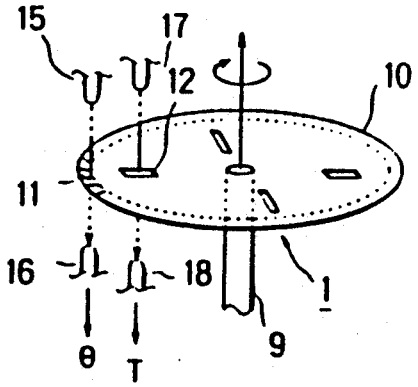
FIG. 5 PRIOR ART
FIG. 5 is a perspective view showing the construction of a known signal generator.
Figure 6:
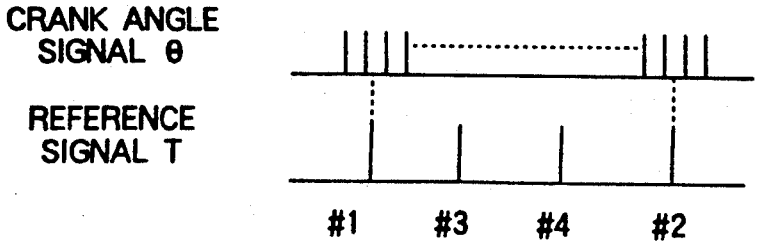
FIG. 6 PRIOR ART
FIG. 6 is a waveform diagram showing the waveforms of a crank angle signal $\theta$ and a reference signal T generated by the known signal generator of FIG. 5.

Referring to the drawings and first to FIG. 1, an apparatus for controlling an internal combustion engine in accordance with the present invention is illustrated in block form. The illustrated engine control apparatus includes a signal generator in the form of a crank angle sensing means 20 for sensing the rotational angle of a crankshaft of the engine and generating a corresponding crank angle signal $\theta$, a plurality of cylinder pressure sensors 21 provided one for each cylinder of the engine for sensing the internal pressure therein and generating a corresponding cylinder pressure signal P, a starter switch 22 for generating an output signal C when a starter or key switch is turned on for engine cranking, sensor means 23 for sensing various operating conditions of the engine and generating a corresponding output signal D, and a control unit 40 which receives the output signals $\theta$, P, C and D from the crank angle sensing means 20 and controls, based thereon, the operation of the engine. In this regard, though not illustrated, the crank angle sensing means 20 of the invention can be substantially the same with the signal generator 1 of FIG. 5 except for the following. Namely, it generates no reference signal, and therefore no slits 12 are provided in the rotating disk 10 and corresponding photocouplers 17, 18 of FIG. 5 are omitted. Accordingly, the arrangement and construction of the crank angle sensing means 20 are considerably simplified and precision is not so required in mounting the rotating disk 10 on the rotating shaft 9.

The control unit 40 includes a cranking cycle determining means 41 for determining, based on the cranking signal C from the starter switch 22, whether the engine is in a starting or cranking cycle, and generating an output signal H if it is determined that the engine is in a starting or cranking cycle, a pressure peak sensing means 42 responsive to the output signal H from the cranking cycle determining means for sensing, based on the cylinder pressure signal P from the cylinder pressure sensor 21, a peak value in the cylinder pressure during the engine cranking cycle, and generating a corresponding output signal DP, a reference position determining means 43 for determining, based the crank angle signal $\theta$ from the crank angle sensing means 20 and the output signal DP from the pressure peak detecting means 42, a reference crank position indicative of the crank angle at the instant when the peak in the cylinder pressure is detected, and generating a corresponding output signal T$\theta$, and a control timing setting means for setting an appropriate engine control timing in the form of ignition timing based on the output signals $\theta$, P, D and C from the sensors 20, 21, 23 and the starter switch 22 and generating a corresponding engine control signal Ta in the form of an ignition signal to an unillustrated ignition system.

Figure 2:
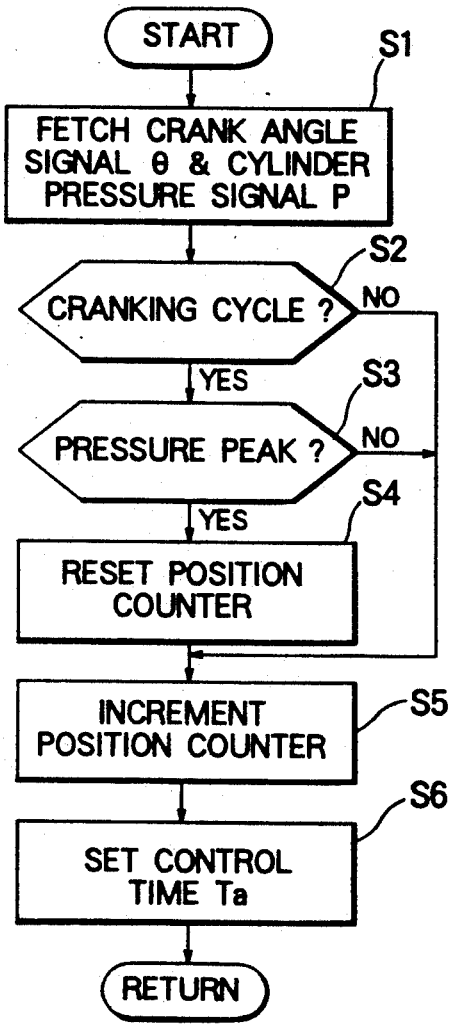
FIG. 2 is a flow chart showing one example of an engine control method in accordance with a preferred embodiment of the invention.
Figure 3:
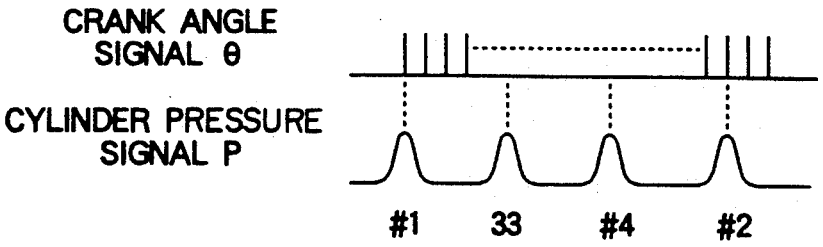
FIG. 3 is a waveform diagram showing the waveforms of a crank angle signal $\theta$ and a cylinder pressure signal P employed in the invention.
Figure 4:
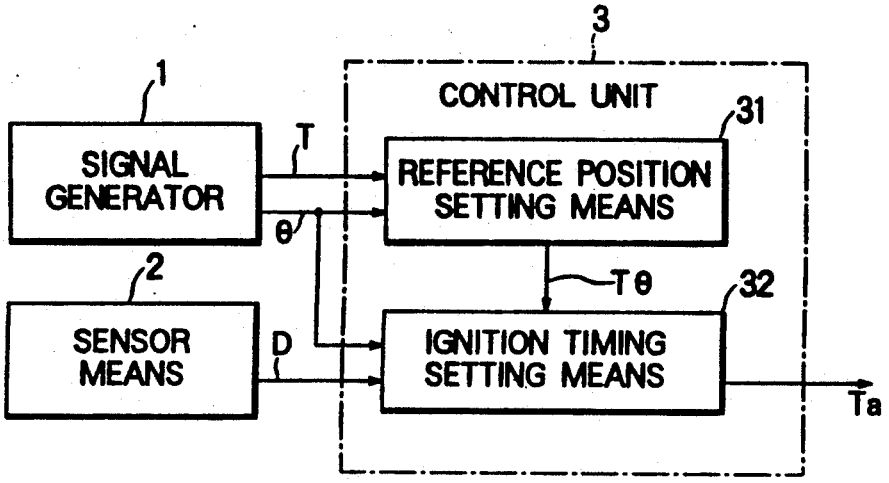
FIG. 4 PRIOR ART
FIG. 4 is a block diagram for showing a known engine control apparatus.

The operation of this embodiment will be described in detail while referring to the flow chart of FIG. 2 and the waveform diagram of FIG. 3. First, in Step S1, the cranking cycle determining means 41 fetches a crank angle signal $\theta$ from the crank angle sensing means 20 and a cylinder pressure signal P from the cylinder pressure sensor 21, and then in Step S2, it determines, based on the crank angle signal $\theta$, whether the engine is in a cranking cycle. In this connection, if the starter switch 22 is turned on to generate a cranking signal C of a high level (i.e., if the engine is in a cranking cycle), the cranking cycle determining means 41 generates a cranking cycle determination signal H for a predetermined time from the start of engine cranking. In general, during the predetermined time from the start of cranking, an illustrated sel-motor is energized to rotate the engine crankshaft for engine cranking, and hence each cylinder is in a misfiring state so that the cranking cycle determining signal H generated is indicative of misfiring in each cylinder.

In Step S3, upon receipt of the cranking cycle determination signal H, the pressure peak detecting means 42 is enabled to determine whether the cylinder pressure signal P is at a peak, in order to detect a peak in the cylinder pressure during the engine cranking cycle. In this regard, a cylinder pressure signal P from the cylinder pressure sensors 21 each provided for a corresponding cylinder takes a peak at top dead center of each of cylinders #1, #3, #4 and #2, as shown in FIG. 3. If the pressure peak detecting means 42 detects a pressure peak and generates a peak detection signal DP, the reference position setting means 43 generates a reference position signal T$\theta$ while making a crank angle signal $\theta$ issued upon detection of the pressure peak as a reference position (TDC).

In Step S4, the control timing setting means 44 resets, at the reference position indicated by the reference position signal T$\theta$, an unillustrated position counter which is built in the control timing setting means 44 for counting the number of pulses in the crank angle signal $\theta$. Then in Step S5, it increments the position counter in response to the crank angle signal $\theta$.

Subsequently, in Step S6, the control timing setting means 44 sets, based on the engine operating condition signal D, the cylinder pressure signal P and the counted value of the position counter, a control time Ta corresponding to an ignition timing for each cylinder.

On the other hand, if in Step S2 it is determined that the engine is not in a cranking cycle or if in Step S3 it is determined that the detected cylinder pressure is not in a peak, then in Step S5, the control timing setting means 44 counts the crank angle signal $\theta$, i.e., incrementing the built-in position counter.

In this manner, the top dead center of each cylinder is set as a reference position on the basis of a peak in the cylinder pressure signal P, whereby only a single detection system is sufficient for the crank angle sensing means 20. Moreover, since a cylinder pressure peak in an engine cranking cycle exactly indicates TDC of a cylinder, no adjustment is needed for the mounting position of the rotating disk, and the degree of accuracy in detecting TDC depends upon the resolution of the crank angle signal $\theta$.

Although in the above-mentioned first embodiment, the cylinder pressure sensor 21 is provided for each cylinder, a single one can be employed for one cylinder alone since the control timing setting means 44 can successively identify the operating state or stroke of each cylinder and determine the crankshaft angle on the basis of the counted value of pulses in the crank angle signal $\theta$ while making the cylinder, for which a pressure peak has been detected, as a specific or reference cylinder.

Moreover, although in the first embodiment, engine control timing is ignition timing, it may be other control timing such as fuel injection timing and the like with substantially the same results.

Furthermore, in the first embodiment, the control time Ta is calculated from a reference position (i.e., TDC), but it can be done from a different reference position such as 75 degrees before TDC (B75°), or 5 degrees before TDC (B5°) or the like on the basis of the counted value of the position counter.

What is claimed is:

1. An apparatus for controlling an internal combustion engine, comprising:

crank angle sensing means for generating a crank angle signal comprising a series of successive pulses in synchronization with the rotation of the engine;

pressure sensing means for sensing an internal pressure in at least one of cylinders of the engine and generating a corresponding cylinder pressure signal;

pressure peak detecting means for detecting a peak in the internal pressure in said at least one cylinder during an engine cranking cycle;

reference position setting means for setting as a reference position the crank angle signal at the instant when the pressure peak in said at least one cylinder is detected; and control timing setting means including a position counter which counts the number of pulses in said crank angle signal and which is resets in response to an occurrence to said reference position, said control timing setting means being operable to set a control time corresponding to a control timing for each of said cylinders on the basis of a counted value of said counter.

2. A method for controlling an internal combustion engine, comprising the steps of:

sensing a crank angle signal which comprises a series of successive pulses generated in synchronization with the rotation of the engine;

sensing an internal pressure in at least one of cylinders of the engine;

determining whether the engine is in a cranking cycle;

detecting a peak in the internal pressure in said at least one cylinder during an engine cranking cycle;

resetting a position counter which counts the number of pulses in the crank angle signal, when the pressure peak in said at least one cylinder is detected; and setting a control time corresponding to a control timing for each of said cylinders on the basis of a counted value of said counter.

* * * * *